US007165986B2

(12) United States Patent
Hayakawa

(10) Patent No.: US 7,165,986 B2
(45) Date of Patent: Jan. 23, 2007

(54) SOCKET FOR ELECTRICAL PARTS

(75) Inventor: Kenji Hayakawa, Saitama (JP)

(73) Assignee: Enplas Corporation, Saitama (JP)

( * ) Notice: Subject to any disclaimer, the term of this patent is extended or adjusted under 35 U.S.C. 154(b) by 0 days.

(21) Appl. No.: 11/258,007

(22) Filed: Oct. 26, 2005

(65) Prior Publication Data

US 2006/0094279 A1 May 4, 2006

(30) Foreign Application Priority Data

Oct. 29, 2004 (JP) ..... 2004-315342

(51) Int. Cl.
*H01R 11/22* (2006.01)

(52) U.S. Cl. ..... 439/268; 439/331

(58) Field of Classification Search ..... 439/268, 439/331, 70

See application file for complete search history.

(56) References Cited

U.S. PATENT DOCUMENTS 6,296,505 B1 * 10/2001 Fukunaga et al. ..... 439/268
6,929,486 B2 * 8/2005 Shimada ..... 439/70
6,957,965 B2 * 10/2005 Huang et al. ..... 439/70
6,984,142 B2 * 1/2006 Shimizu ..... 439/268
2002/0106925 A1 * 8/2002 Yamagishi ..... 439/331
2003/0109163 A1 * 6/2003 Shimada ..... 439/331
2003/0114034 A1 * 6/2003 Sano et al. ..... 439/331
2003/0171021 A1 * 9/2003 Okamoto ..... 439/331
2003/0190831 A1 * 10/2003 Hachuda ..... 439/331

FOREIGN PATENT DOCUMENTS

JP 2002-8809 1/2002

* cited by examiner

*Primary Examiner*—Tulsidas C. Patel
*Assistant Examiner*—Vladimir Imas
(74) *Attorney, Agent, or Firm*—Staas & Halsey LLP

(57) ABSTRACT

A socket for an electrical part includes a socket body to which an electrical part is accommodated, the socket body having a base portion to which a number of elastic contact pins are arranged, a movable member disposed to the socket body above the base portion to be vertically movable, contact portions, between which a terminal of the electric part is inserted, formed to the contact pins being opened or closed, and a preloading member adapted to elastically deform the elastic pieces in a direction of closing the contact portions of the contact pins.

10 Claims, 18 Drawing Sheets

SOCKET FOR ELECTRICAL PARTS

BACKGROUND OF THE INVENTION

1. Field of the Invention

The present invention relates to a socket for an electrical part for detachably holding an electrical part such as a semiconductor device (called as "IC package" hereinlater).

2. Related Art

In a known art, there has been provided an IC socket, as "socket for an electrical part" for detachably holding an "IC package" as an electrical part such as disclosed in Japanese Laid-Open (KOKAI) Patent Publication No. 2002-8809.

The IC package disclosed in this publication includes a number of solder balls, as terminals, which are arranged on a lower surface of the IC package so as to protrude therefrom in an lattice arrangement including vertical rows Y and horizontal lines X.

The IC socket, on the other hand, includes a socket body in which the IC package is accommodated and which is provided with a number of contact pins contacting the terminals of the IC package. The socket body is also provided with a movable (moving) member vertically movable to elastically deform the contact pins so as to be contacted or separated to or from the terminals of the IC package.

The socket body is further provided with a lever member to vertically move the movable member to be rotatable through a rotation shaft, i.e., pivot, and an operation member for rotating or pivoting the lever member is also provided to the socket body to be vertically movable.

By vertically moving the operation member, the lever member is rotated and, hence, the movable member is vertically moved, thus elastically deforming the contact pins, and accordingly, contact portions of the contact pins are contacted to or separated from the terminals of the IC package, respectively.

However, in the conventional structure of the IC socket mentioned above, it is necessary to maintain or ensure contact pressure at the time of clamping the terminal of the IC package and contacting it to a pair of contact portions of each contact pin, and in order to ensure such contact pressure, it has been required for the contact pin to have a relatively large elasticity, and on the contrary, in order to reduce influence between the terminal and the contact portions of the contact pin at the IC packaging insertion time, it is necessary to ensure a relatively large opening distance between the paired contact portions. In view of these matters, when the contact pin having relatively large elasticity is utilized to ensure the predetermined contact pressure, a relatively large operating force is required for ensuring the relatively large opening distance. This matter may cause the device to be inoperative state if the number of contact pins further increases, thus being inconvenient and disadvantageous.

SUMMARY OF THE INVENTION

The present invention was then conceived to eliminate the defects or inconveniences encountered in the prior art mentioned above and an object of the present invention is to provide a socket for an electrical part capable of being operated with a small operating force even with contact pressure of the contact pin and opening amount or distance being suitably ensured.

This and other objects can be achieved according to the present invention by providing a socket for an electrical part, which comprises: a socket body to which an electrical part is accommodated, the socket body having a base portion (or member) to which a plurality of contact pins, having elastic pieces, which are contacted to or separated from terminals of the electrical part, are arranged; a movable member disposed to the socket body above the base portion thereof to be vertically movable, deformation of the elastic pieces of the contact pins inserted into an insertion hole formed to the movable member being performed in accordance with the vertical movement of the movable member, according to the deformation thereof, contact portions formed to the contact pins being opened or closed; and a preloading member adapted to elastically deform the elastic pieces in a direction of closing the contact portions of the contact pins in a state that the contact pins are inserted into insertion holes of the base portion of the socket body.

In preferred embodiments, the preloading member may be composed of preloading projections formed to a pair of elastic pieces of the respective contact pins, the paired elastic pieces are elastically deformed in the direction closing both the contact portions of the contact pins through abutment of the preloading projections against the inner wall of the insertion hole of the base portion.

The contact pins will be inserted upward from a lower side of the insertion hole of the base portion of the socket body.

The contact pins are provided with stopper pieces, respectively, abutting against a lower surface of the base portion, and a support member is further disposed below the base portion so as to block downward movement of the stopper member.

According to the present invention of the characters and structures mentioned above, since the preloading member for elastically deforming both the elastic pieces of each contact pin in the direction of closing both the contact portions of the contact pin in a state that the contact pin is inserted into the insertion hole of the base portion of the socket body, the contact pressure of the contact portions to the terminal can be ensured even if the elastic pieces have weak elastic force, and in addition, when both contact portions are opened, they can be easily opened with weak opening force and suitable opening distance can be ensured.

Therefore, even if a large number of contact pins are arranged, both contact portions of the respective contact pins can be easily opened, and suitable contacting pressure to the terminals of the IC package can be ensured.

In addition, since the preload is uniformly given to the paired elastic pieces, and since the movable member is vertically moved to thereby open or close the paired contact portions, the opposing forces from the contact pins are equally applied to the respective insertion holes of the movable member. Accordingly, a large unidirectional force as a whole is never applied to the movable member, and hence, the deformation of the movable member can be also suppressed. Thus, in this viewpoint, it becomes possible to locate an increased number of contact pins.

Furthermore, in the preferred embodiment, the preloading member is composed of preloading projections which are formed to the paired elastic pieces of the contact pins, respectively. When the preloading projections abut against the inner wall of the insertion hole of the base portion, the contact portions of the elastic pieces can be elastically deformed in the closing direction thereof, so that the preload can be applied with simple structure.

Still furthermore, since the contact pins are inserted into the insertion holes of the base portion of the socket body from the lower side thereof, the contact pins can be inserted all at once from the lower side in a state that the movable member is placed on the base portion of the socket body, whereby the contact pin arrangement working can be easily performed.

Still furthermore, the stopper member is formed to the contact pin so as to abut against the lower surface of the base portion and the support member is also disposed to the lower side of the base portion so as to block the downward movement of the stopper member. Accordingly, the upper limit of the contact portions is limited, so that the contact portions do not project upward over the predetermined position, thus suppressing the damage of the terminal of the electrical part.

In addition, since the support member is disposed below the stopper member of the contact pin so as to block the downward movement of the stopper member, the contact pins can be maintained in their predetermined height level.

The nature and further characteristic features of the present invention will be made more clear from the following descriptions made with reference to the accompanying drawings.

BRIEF DESCRIPTION OF THE DRAWINGS

In the accompanying drawings:

FIG. 8 shows the contact pin of the IC socket of the fist embodiment, in which

DESCRIPTION OF THE PREFERRED EMBODIMENTS

Figure 1:
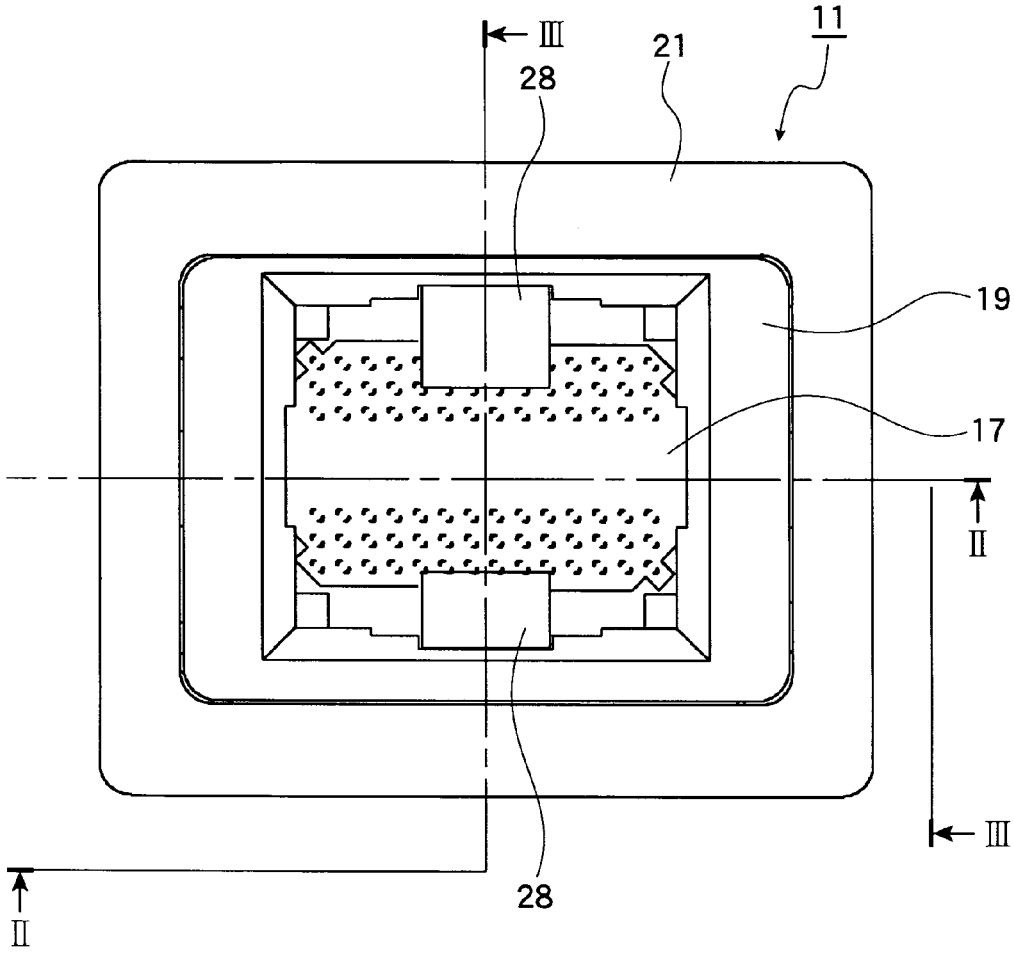
FIG. 1 is a plan view of an IC socket according to a first embodiment of the present invention.

Preferred embodiments of the present invention will be described hereunder with reference to the accompanying drawings.

[First Embodiment]

FIGS. 1 to 14 represent a first embodiment of an IC socket as a socket of an electrical part. Further, it is first to be noted that terms "right", "left", "upper", "lower" and the like terms are used herein with reference to the illustrated state on the drawings or in a generally using state of the IC socket of this kind.

With reference to FIGS. 1 to 14, reference numeral 11 denotes an IC socket as "a socket for an electrical part", which is a socket for establishing an electrical connection between a solder ball 12*b* as a terminal of an IC package 12 as "an electrical part" and a printed circuit board, not shown, of a measuring device such as tester, for carrying out a performance test of the IC package 12.

Figure 6:
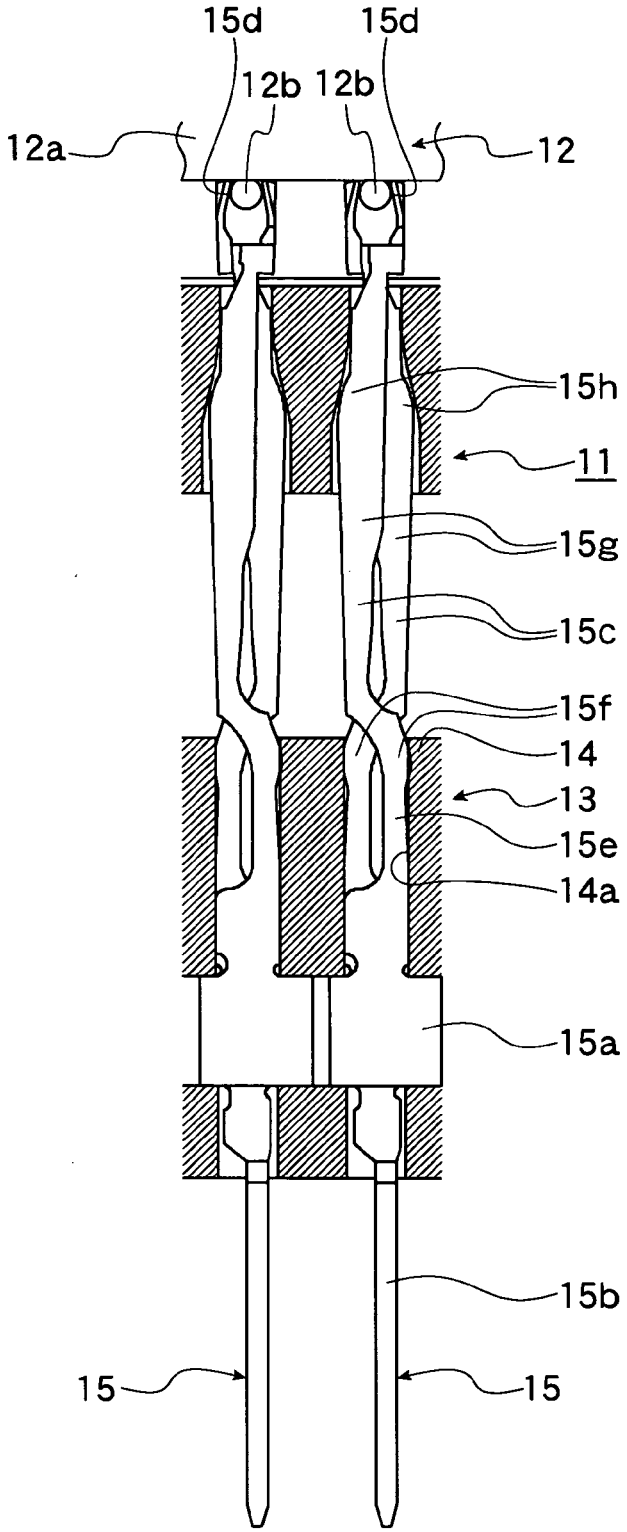
FIG. 6 is a sectional view of a contact pin, in an enlarged scale, in a location when the movable member takes its uppermost position in the first embodiment.

The IC package 12 is so-called an BGA (Ball Grid Array) type, such as shown in FIGS. 6, in which terminals 12*b*, each in a spherical shape, are arranged to a lower surface of a square package body 12*a* of the IC package 12 so as to protrude therefrom in vertical lines and horizontal rows to provide a matrix arrangement.

Figure 2:
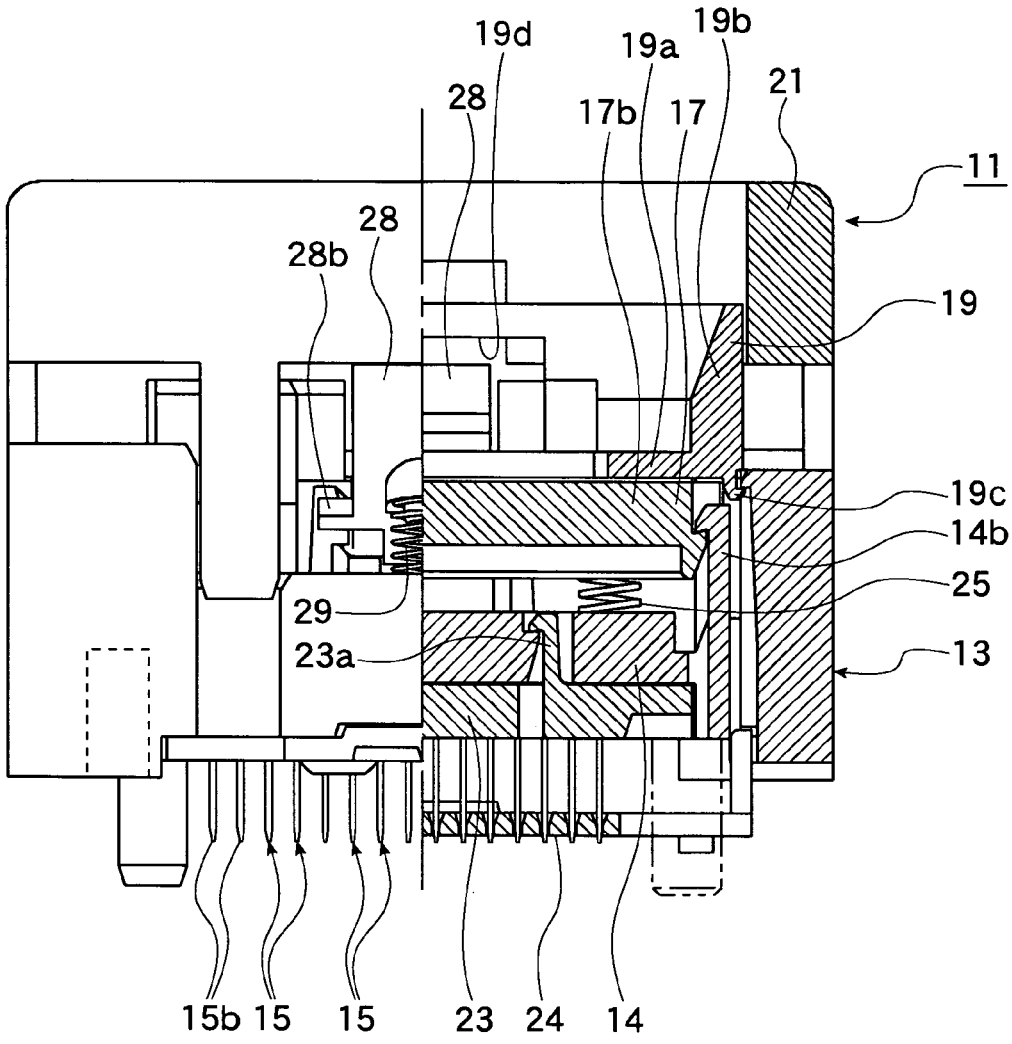
FIG. 2 is a sectional view taken along the line II—II in FIG. 1.

On the other hand, as shown in FIG. 2, the IC socket 11 has a socket body 13, made of synthetic resin, to be mounted on a printed circuit board, not shown, and this socket body 13 is provided with a number of contact pins 15 contacting to and separating from the solder balls 12*b*, respectively, of the IC package 12. The socket body 13 is also provided with a movable (moving) member 17 for displacing the contact pins 15, and a guide member 19 is fixed to the socket body on the upper side of the movable member 17. Furthermore, an operation (or operating) member 21 is also disposed to the socket body 13 so as to vertically move the movable member 17.

Figure 7:
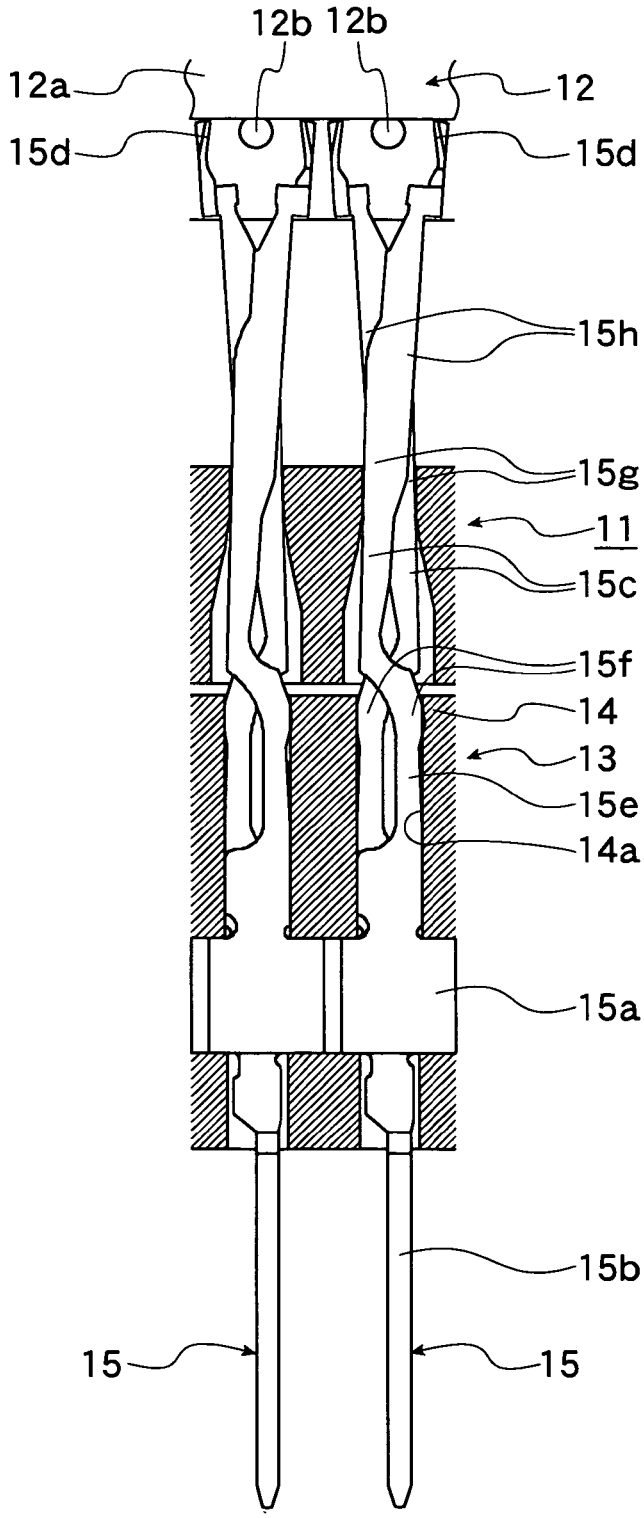
FIG. 7 is a sectional view of a contact pin, in an enlarged scale, in a location when the movable member takes its lowermost position in the first embodiment.
Figure 8A:
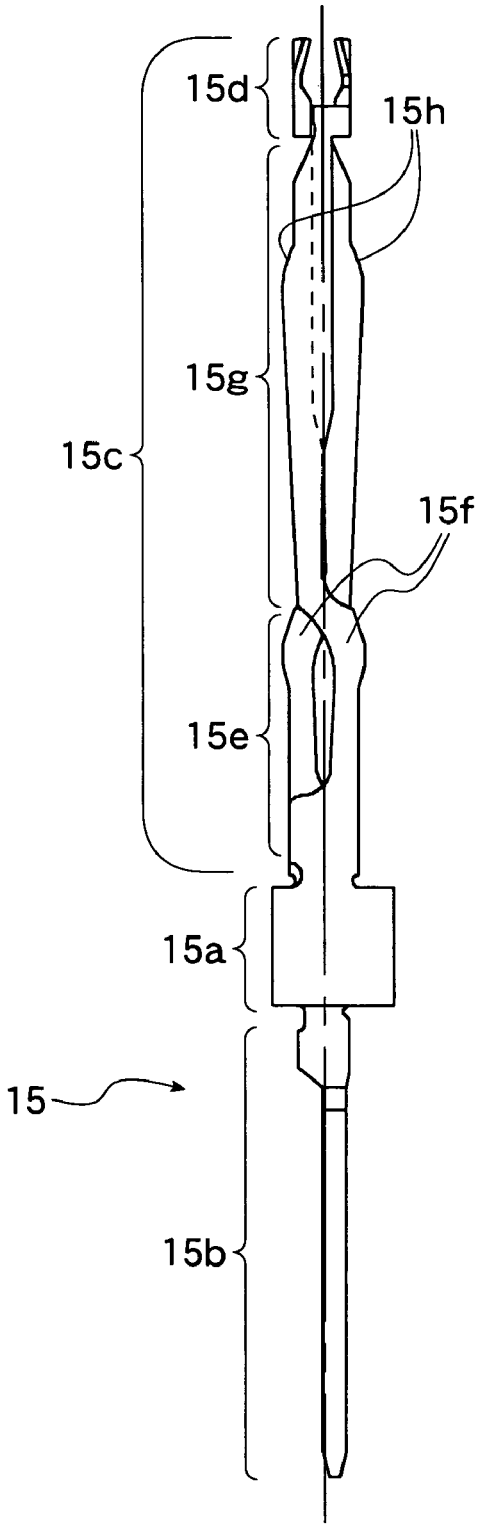
FIG. 8A is a front view of the contact pin and FIG. 8B is a right side view of FIG. 8A.
Figure 8B:
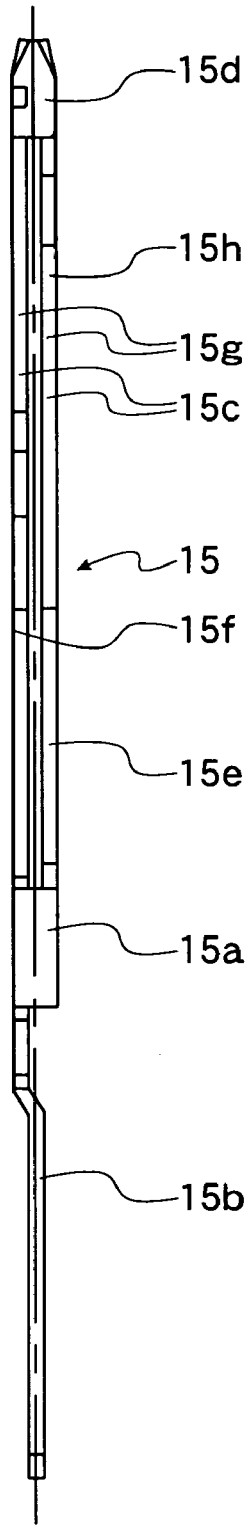

The contact pin 15 is formed from a plate member, rich in a springy property and electrical conductivity, through a press working in a shape as shown in FIGS. 6 to 8.

More specifically, the contact pin has a base portion 15*a* as a stopper portion having U-shape in section at an intermediate portion of the contact pin 15 in its vertical direction and also has a solder tale portion 15*b* formed to the lower side of the base portion 15*a* and has a pair of elastic pieces 15*c* formed to the upper side of the base portion 15*a*.

The paired elastic pieces 15*c* have lower end sides commonly formed as the U-shaped base portion 15*a*, and accordingly, these elastic pieces face to face each other. The elastic pieces 15*c* have upper end sides (front free end side portions) to which contact portions 15*d* are formed so as to contact or separate from the side portion of the solder ball 12*b*, so that when the solder ball 12*b* is clamped between these paired contact portions 15*d*, the electrical connection can be established.

Furthermore, the paired elastic pieces 15*c* have lower portions 15*e* which are inserted into insertion hole 14*a* of a base member or base portion 14, and preloading projections 15*f* are formed to the upper sides of these lower portions 15*e* so as to project sideways. These preloading projections 15*f* abut against an inner wall of the insertion hole 14*a* to thereby be elastically deformed in a direction along which the contact portions 15*d* are closed and to apply the preload.

In addition, sliding or slidable portions 15*g* are formed to the upper sides of the lower portion 15*e* of the paired elastic pieces 15*c* so as to project in a direction opposite to the lower portion (15*e*) side. The slidable portions 15*g* project over the base member 14 and inserted into an insertion hole 17*a* of the movable member 17. When the movable member 17 moves vertically, the inner wall portions of the insertion hole 17*a* slide along the slidable portions 15*g* and, hence, the elastic pieces 15*c* are elastically deformed, thereby opening or closing the paired contact portions 15*d*.

The insertion hole 17*a* of the movable member 17 has a shape downward opened, as viewed such as shown in FIG. 6. Further, the sidable portions 15*g* are formed with bulged portions 15*h*, respectively, and when these bulged portions 15*h* are pushed, both contact portions 15*d* are moved in opening direction as shown in FIG. 7.

Still furthermore, both contact portions 15*d* project upward, as shown in FIG. 6, over the movable member 17 in its uppermost position, and are bent, at the upper end of the slidable portions 15*g*, at substantially right angle so as to face each other to thereby clamp the solder ball 12*b* between the contact pin 15 of the IC socket 11 and the solder ball 12*b* of the IC package 12 to establish the electrical connection therebetween.

Figure 4:
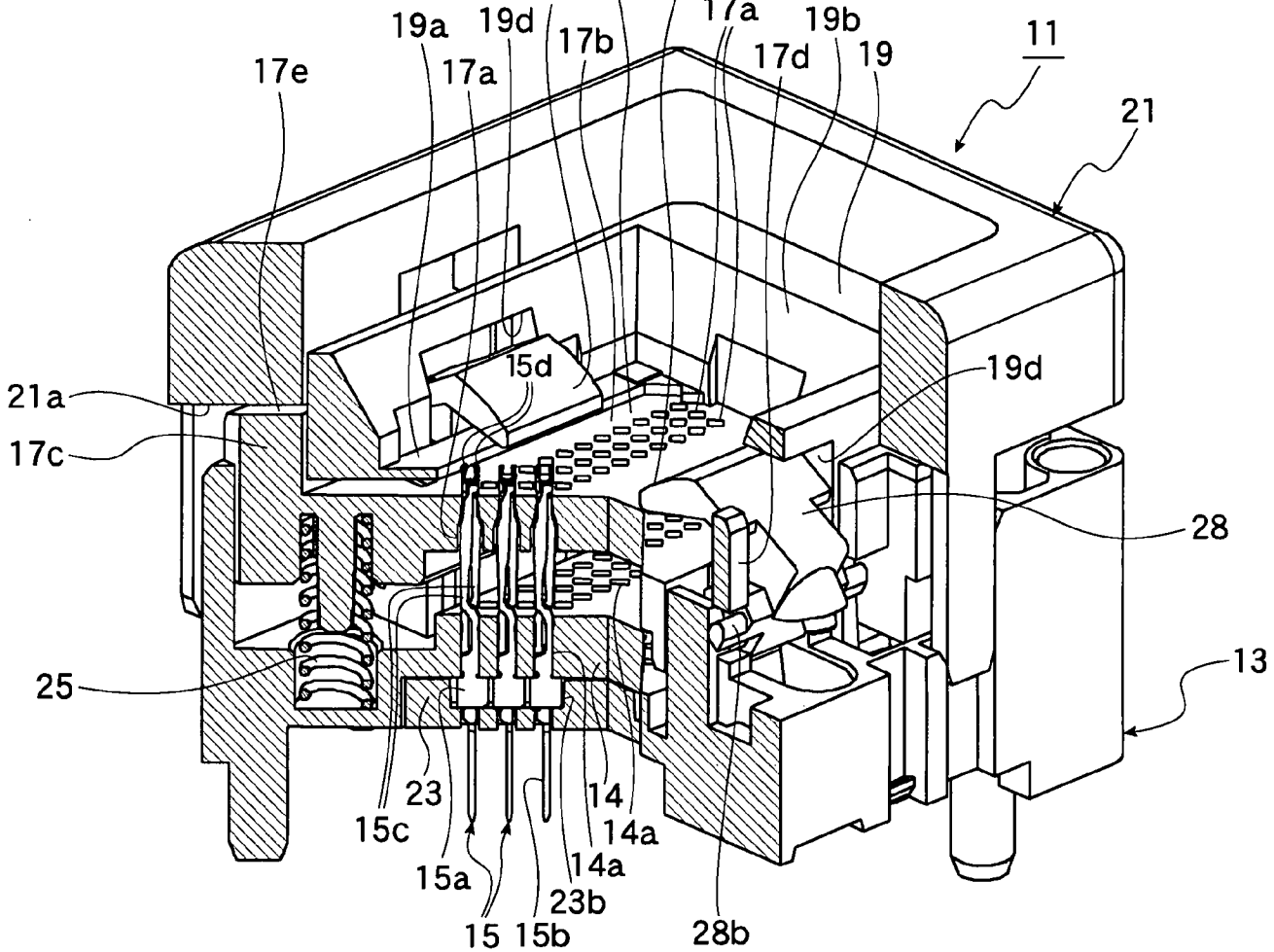
FIG. 4 is a perspective view, partially in section, of the IC socket of the first embodiment, in which a movable member takes an uppermost position thereof.

Further, as shown in FIG. 2, a bottom plate 23 is attached to a lower surface side of the base member 14 as "support member" by means of engaging piece 23*a*. The bottom plate 23 is formed with insertion holes 23*b* through which the solder tale portions 15*b* of the contact pins 15 are inserted as shown in FIGS. 4 and 6. The base portion 15*a* of the contact pin 15 is clamped between the bottom plate 23 and the base member 14 to thereby prevent the bottom plate from moving downward.

Figure 3:
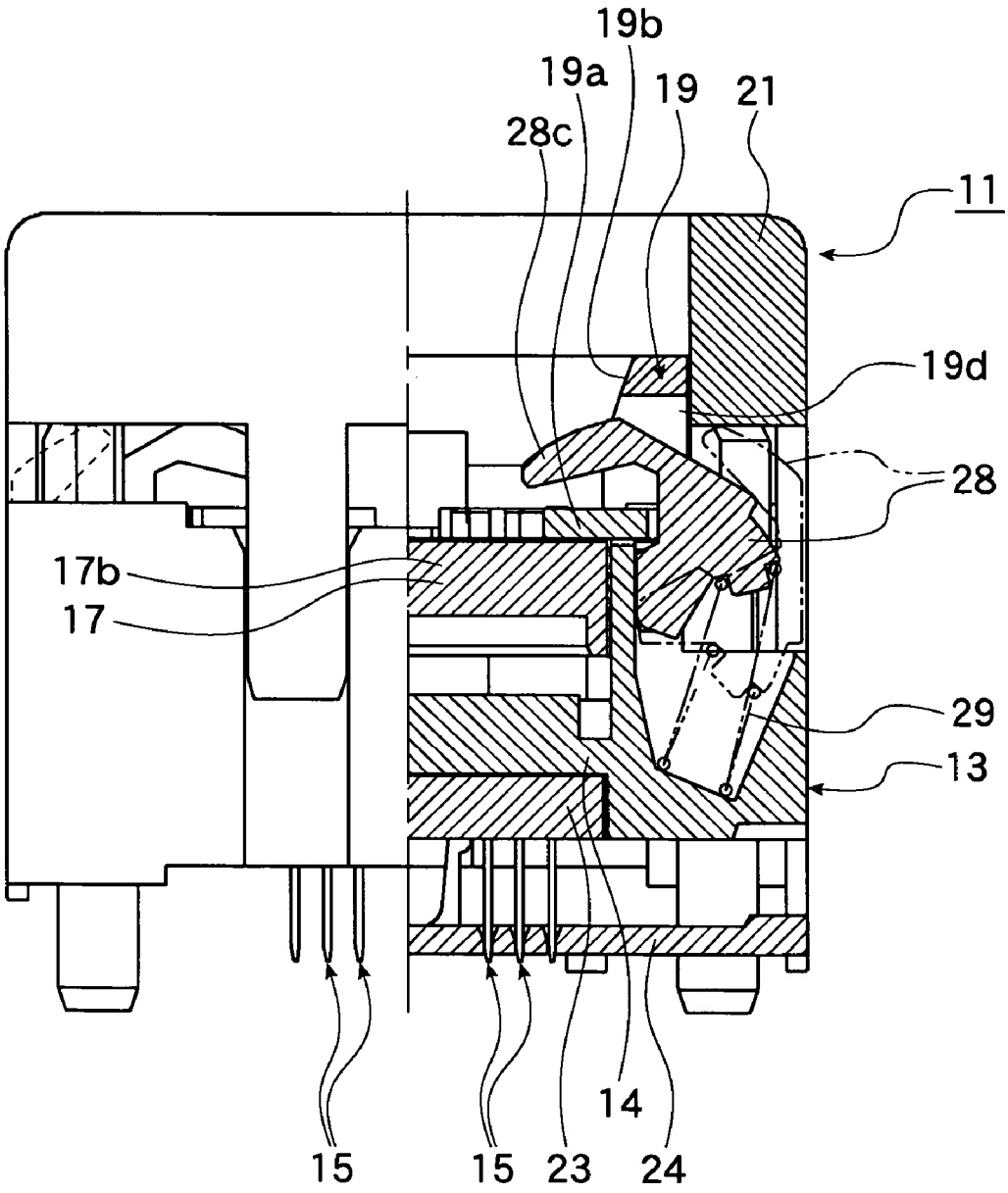
FIG. 3 is a sectional view taken along the line III—III in FIG. 1.

In addition, a location board 24 is disposed to the lower side of the bottom plate 23 to be vertically movable. Each of the solder tail portions 15*b* projecting downward from the bottom plate 23 further projects downward through the location board 24 as shown in FIG. 2 or 3, and then, is inserted into a through hole formed to a printed circuit board, not shown, and then soldered thereto, thus completing the connection.

According to such connection, a number of contact pins 15 are arranged into matrix as shown in FIG. 1 including a plurality of rows and lines.

Figure 9:
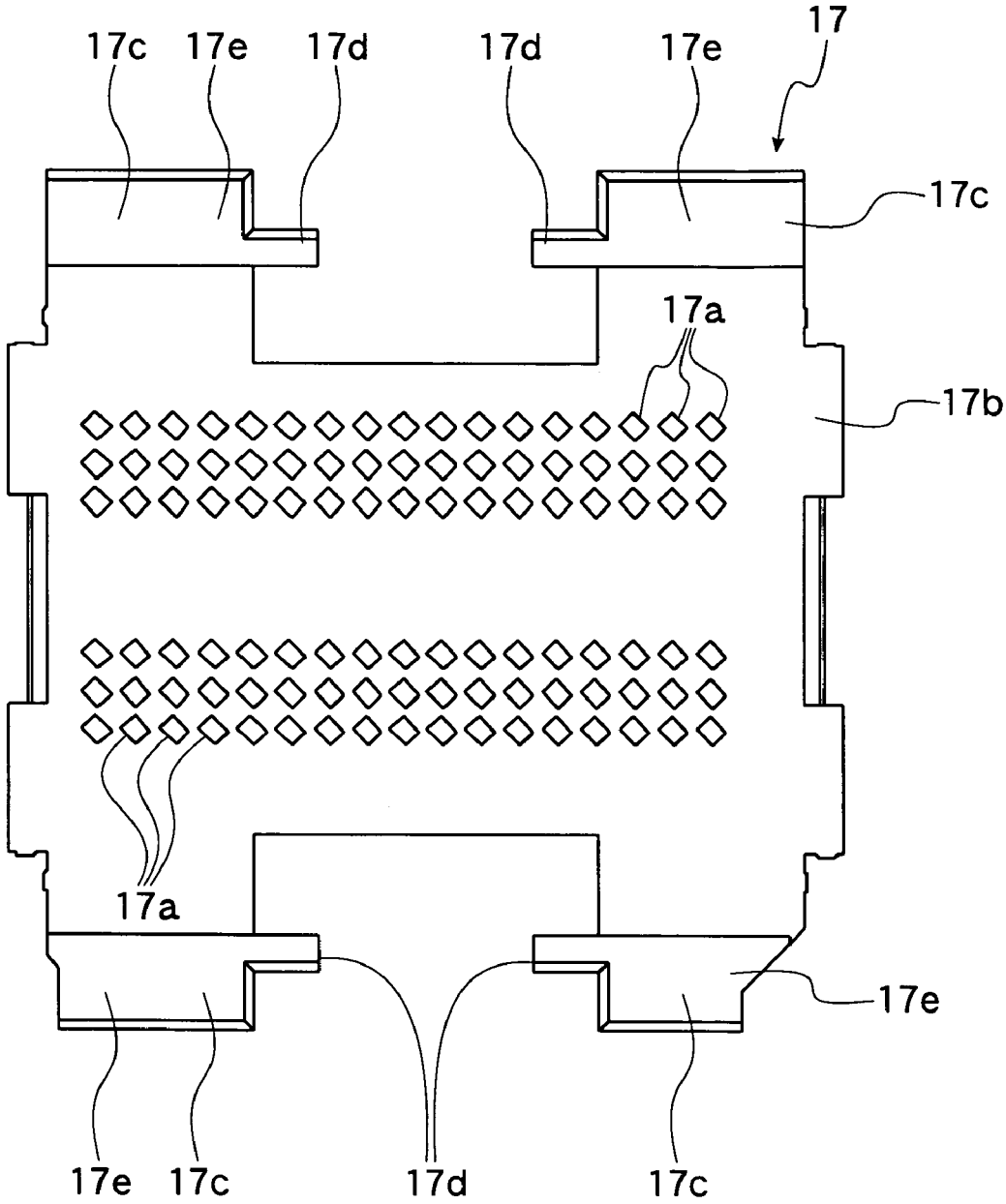
FIG. 9 is a schematic plan view of the movable member of the IC socket of the first embodiment of the present invention.
Figure 10:
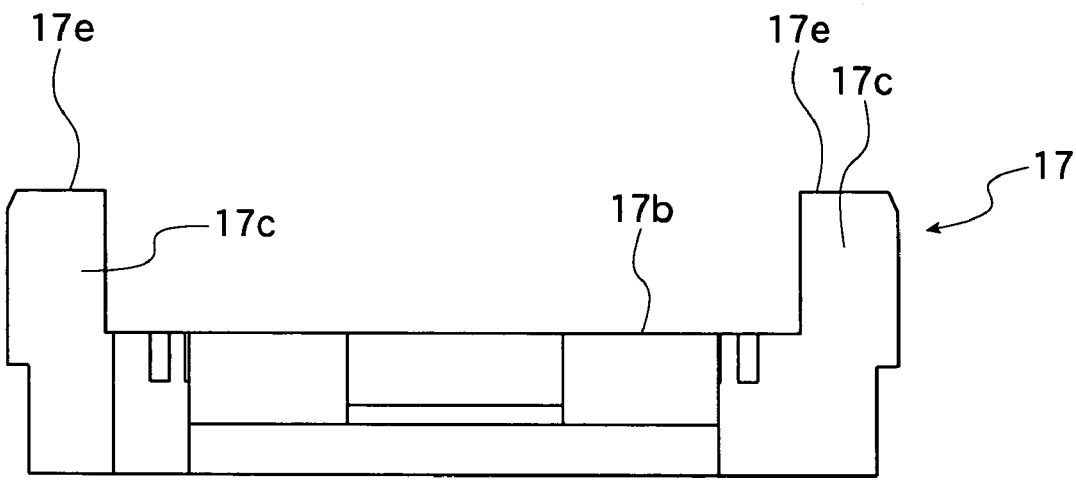
FIG. 10 is a right side view of the movable member of FIG. 9.
Figure 11:
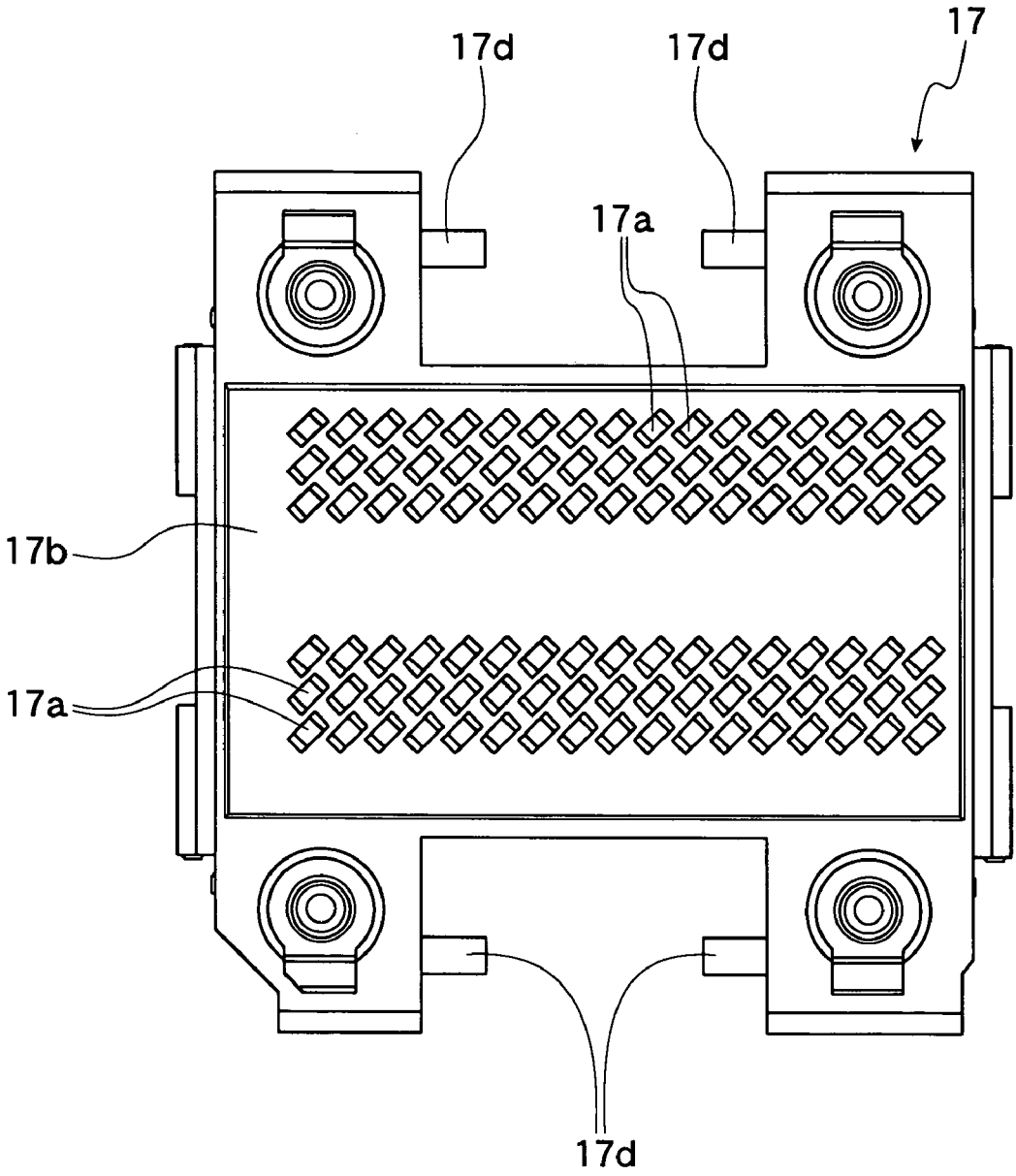
FIG. 11 is a bottom view of the movable member of FIG. 9.

In the meantime, the movable member 17 has, as shown in FIGS. 9 to 11, a movable member body 17*b* in the form of horizontal plate to which a number of insertion holes 17*a* are formed and projection pieces 17*c* projecting upward from end edge portions of the movable member body 17*b*. The movable member 17 is urged upward by a coil spring 24, and the upward movement of the movable member 17 is restricted by the engagement of the engaging portion 14*b* projecting from the base member 14 as shown in FIG. 2.

Further, as shown in FIG. 2, a frame-shaped guide member 19 is disposed inside each projection piece 17*c* above the movable member 17. The guide member 19 is formed with a support piece 19*a* supporting a peripheral edge portion of the package body 12*a*, and a guide 19*b* is disposed to the peripheral edge portion of the support piece 19*a* so as to project upward. According to the location of such guides 19*b*, the IC package 12 is guided when accommodated to the IC socket. The guide member 19 is also provided with an engaging portion 19*c* projecting downward as shown in FIG. 2, and by engaging this engaging piece 19*c* with the base member 14, the guide member 19 is secured. The guide member 19 is formed with an opening 19*d* through which a latch member 28 is inserted or withdrawn, as mentioned hereinlater.

Figure 5:
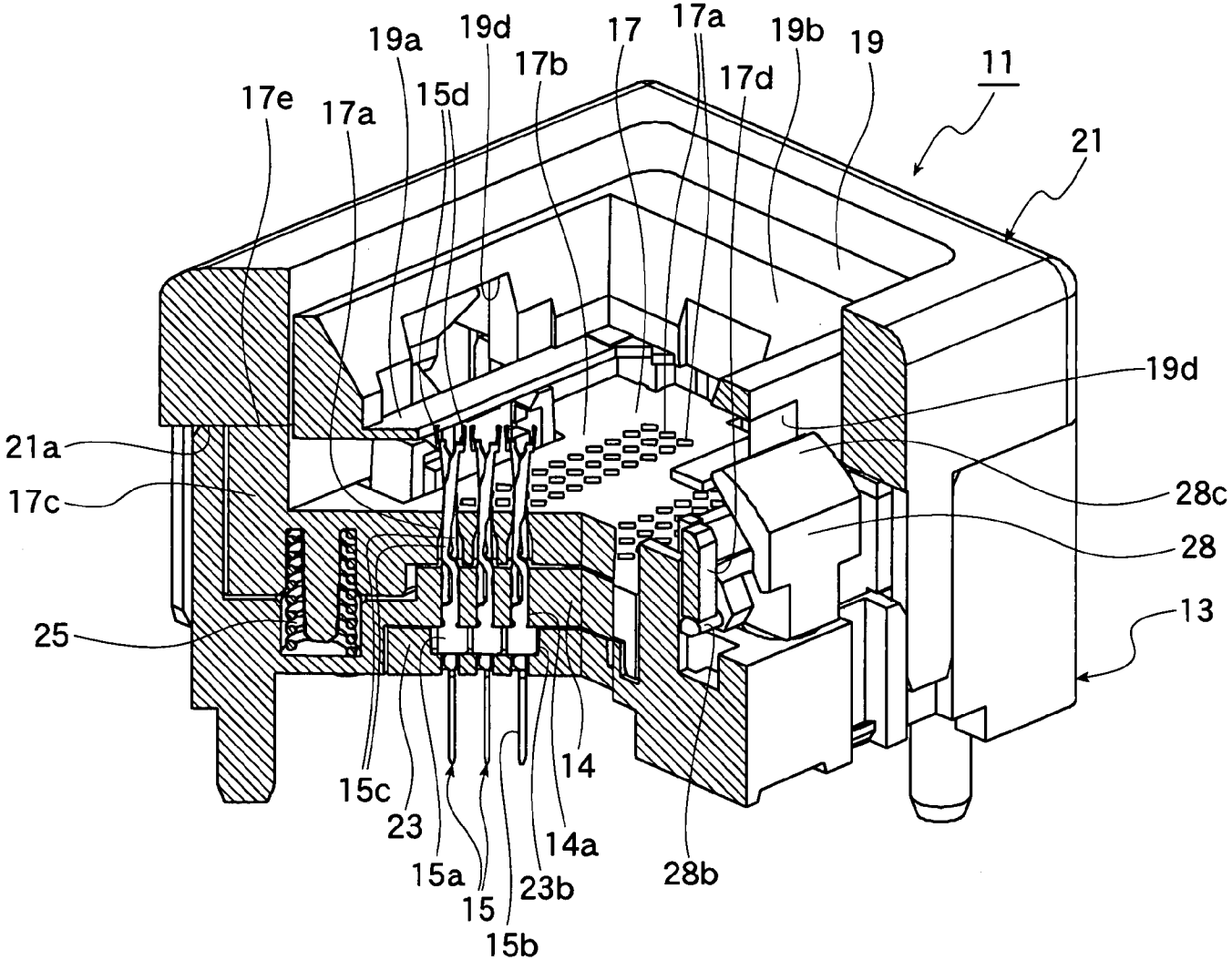
FIG. 5 is a perspective view, partially in section, of the IC socket of the first embodiment, in which a movable member takes a lowermost position thereof.
Figure 12:
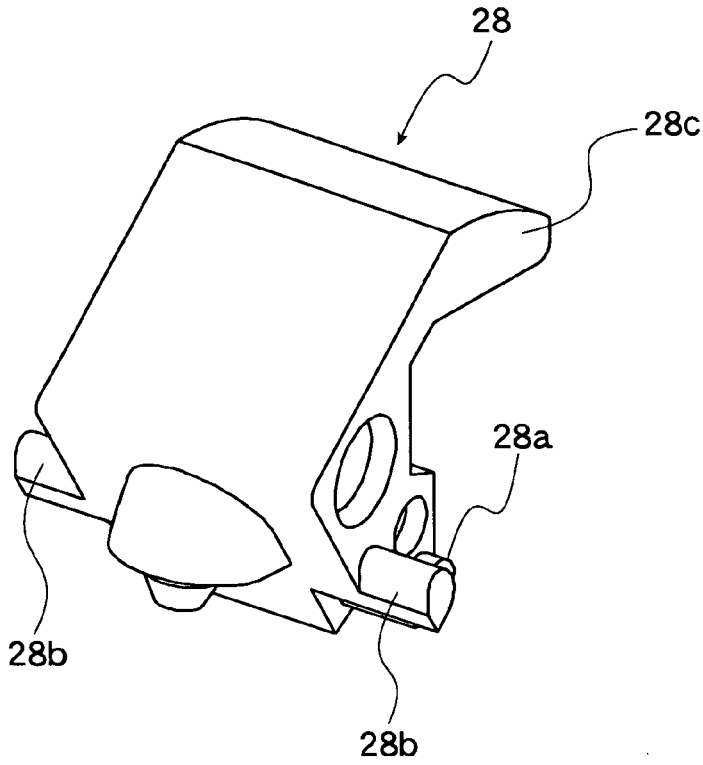
FIG. 12 is a perspective view of a latch member, viewed from an obliquely upper position, according to the first embodiment.
Figure 13:
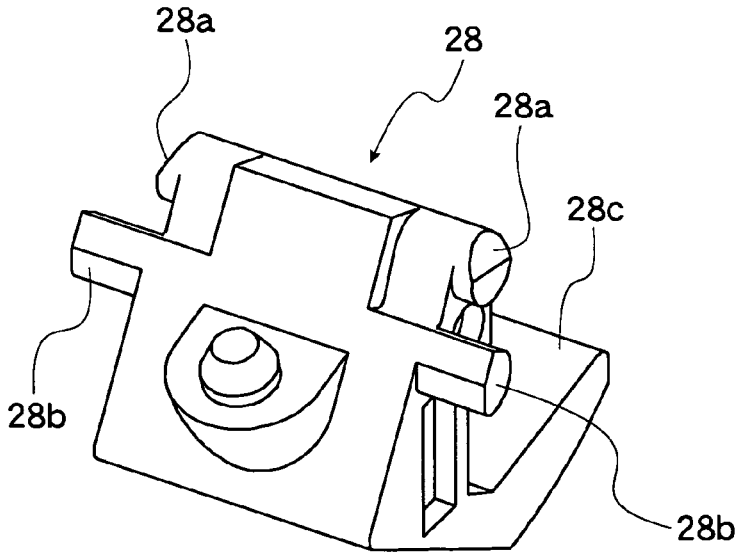
FIG. 13 is a perspective view of a latch member, viewed from an obliquely lower position, according to the first embodiment.
Figure 14:
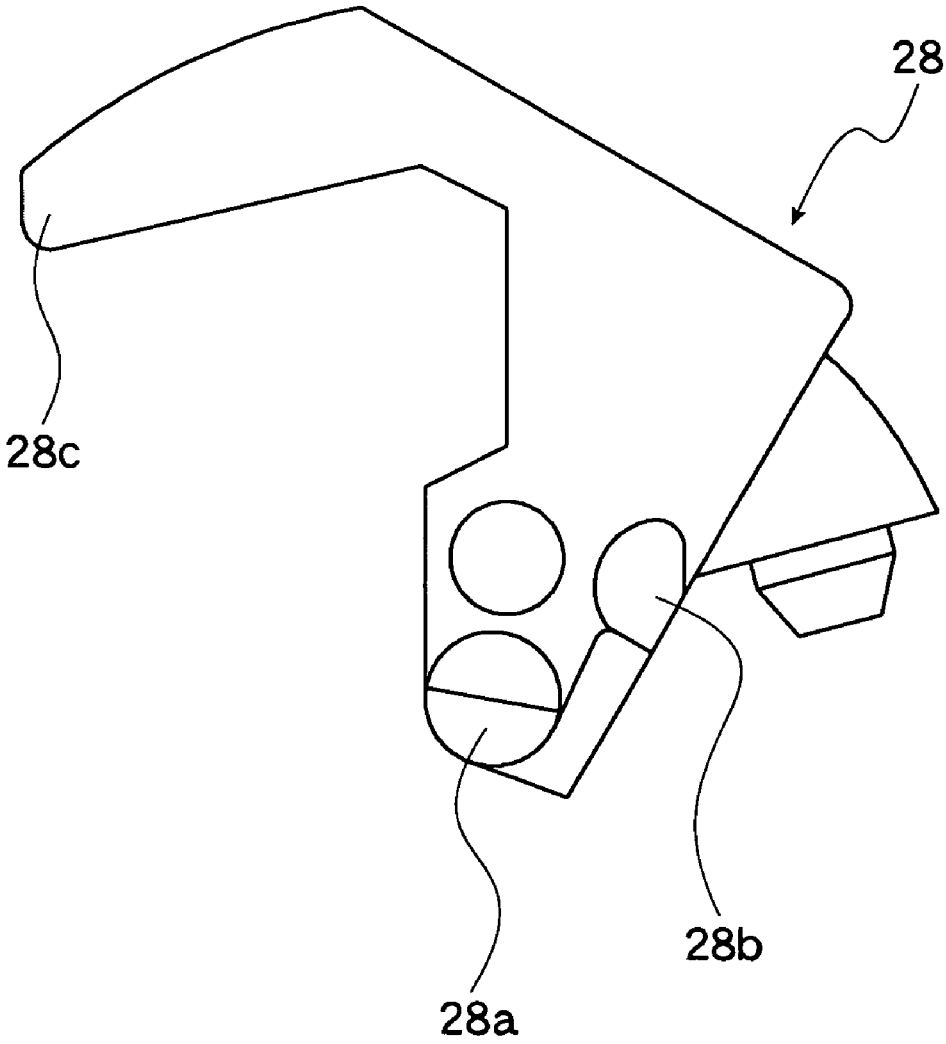
FIG. 14 is a side view of the latch member.
Figure 15:
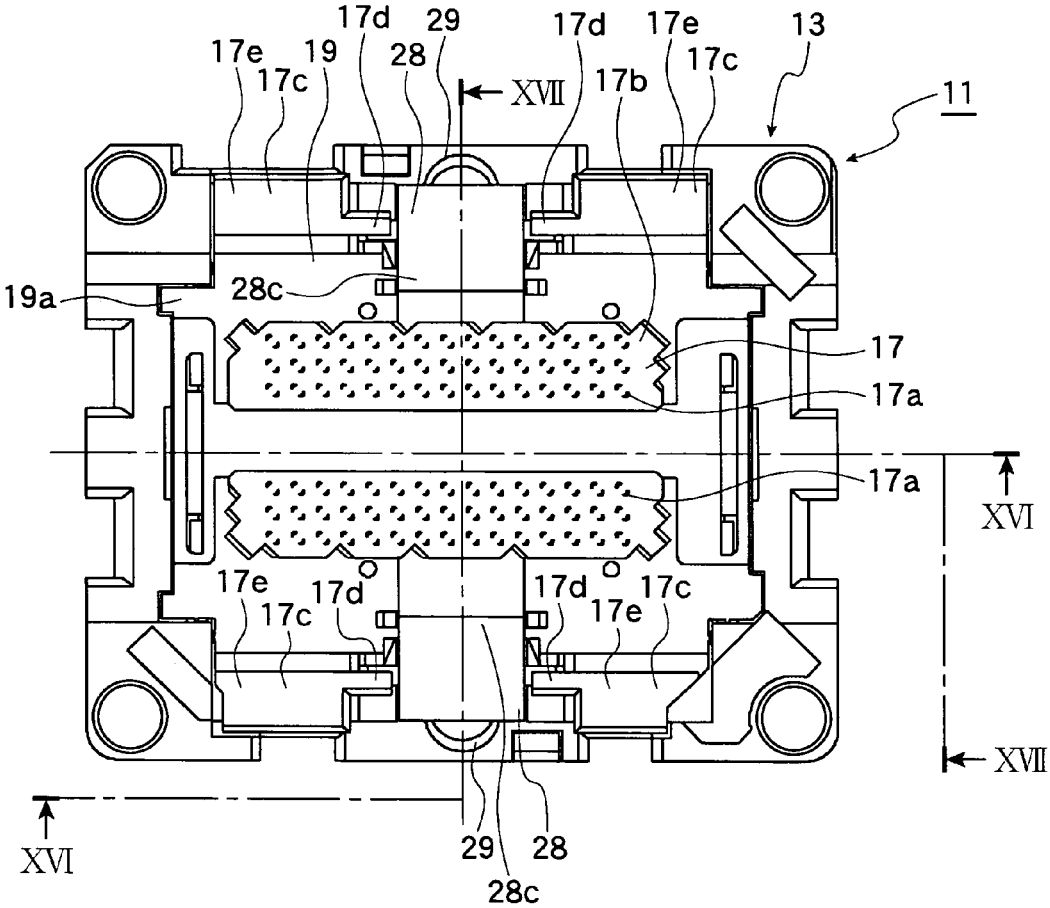
FIG. 15 is a plan view of an IC socket according to a second embodiment of the present invention.
Figure 16:
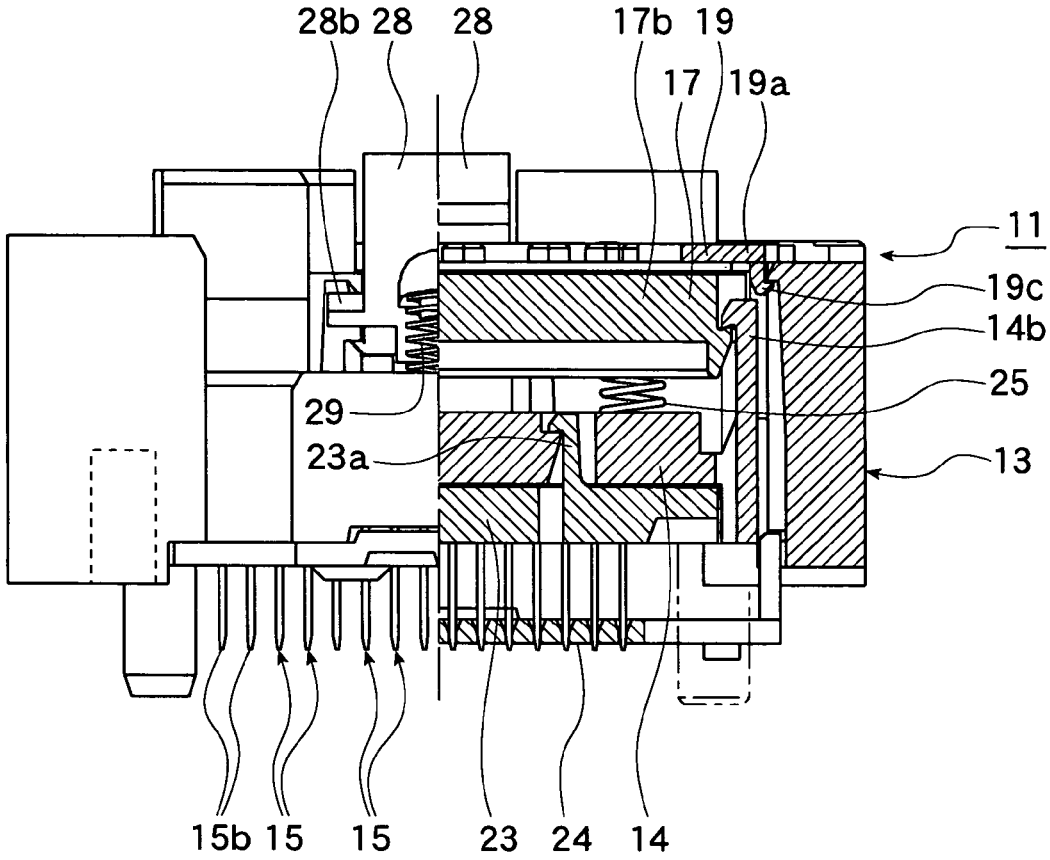
FIG. 16 is a sectional view taken along the line XVI—XVI in FIG. 15.
Figure 17:
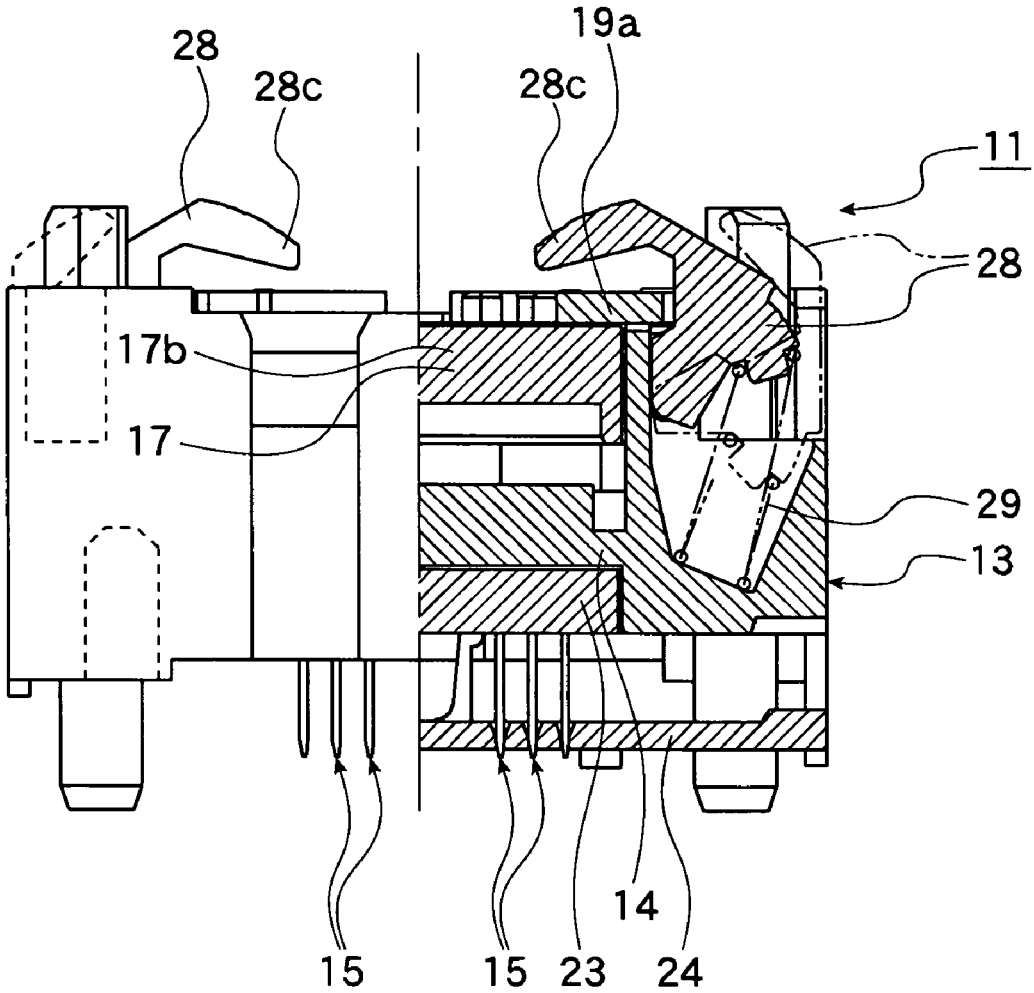
FIG. 17 is a sectional view taken along the line XVII—XVII in FIG. 15.
Figure 18:
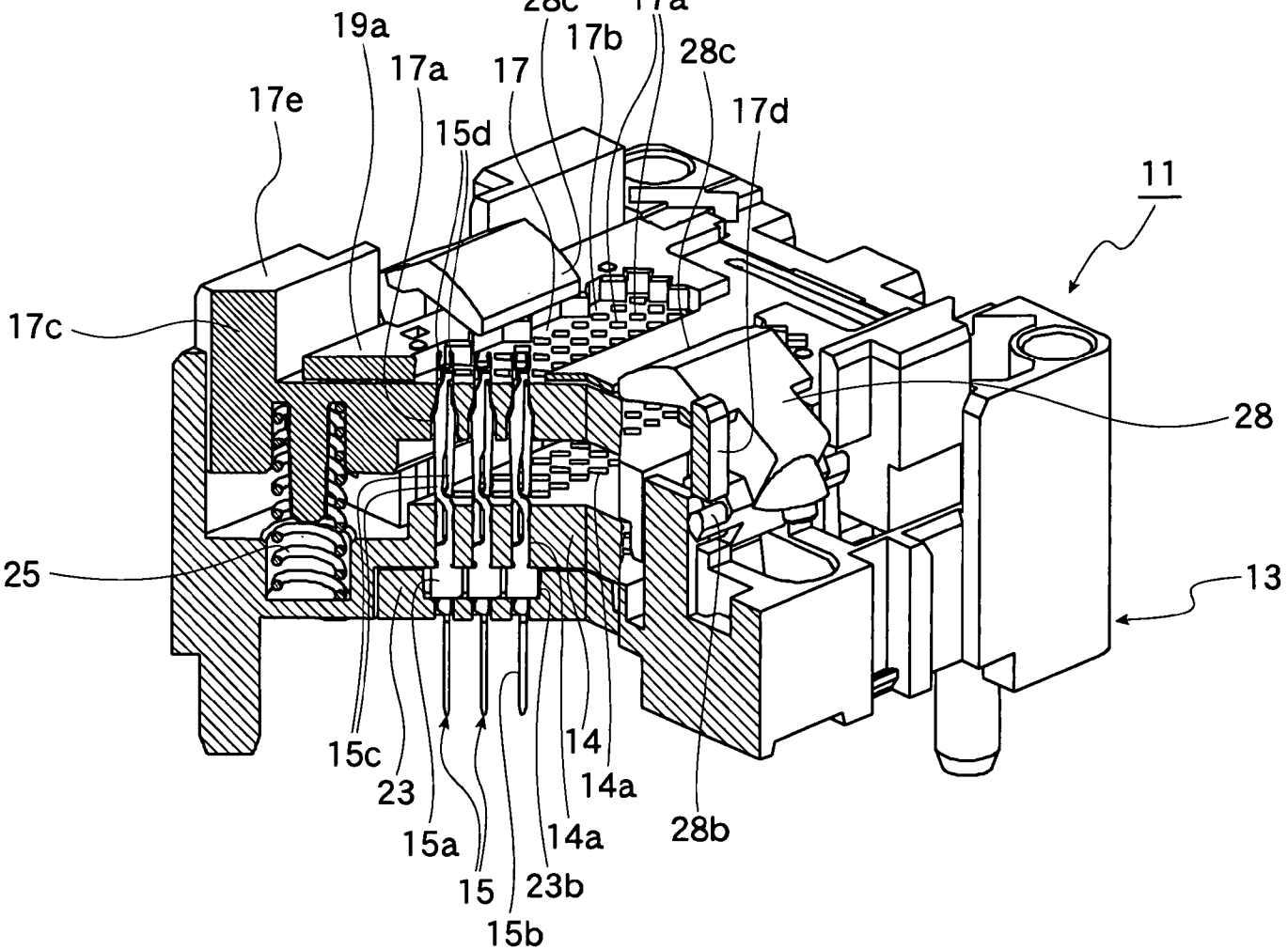
FIG. 18 is a perspective view, partially in section, of the IC socket of the second embodiment, in which a movable member takes an uppermost position thereof.
Figure 19:
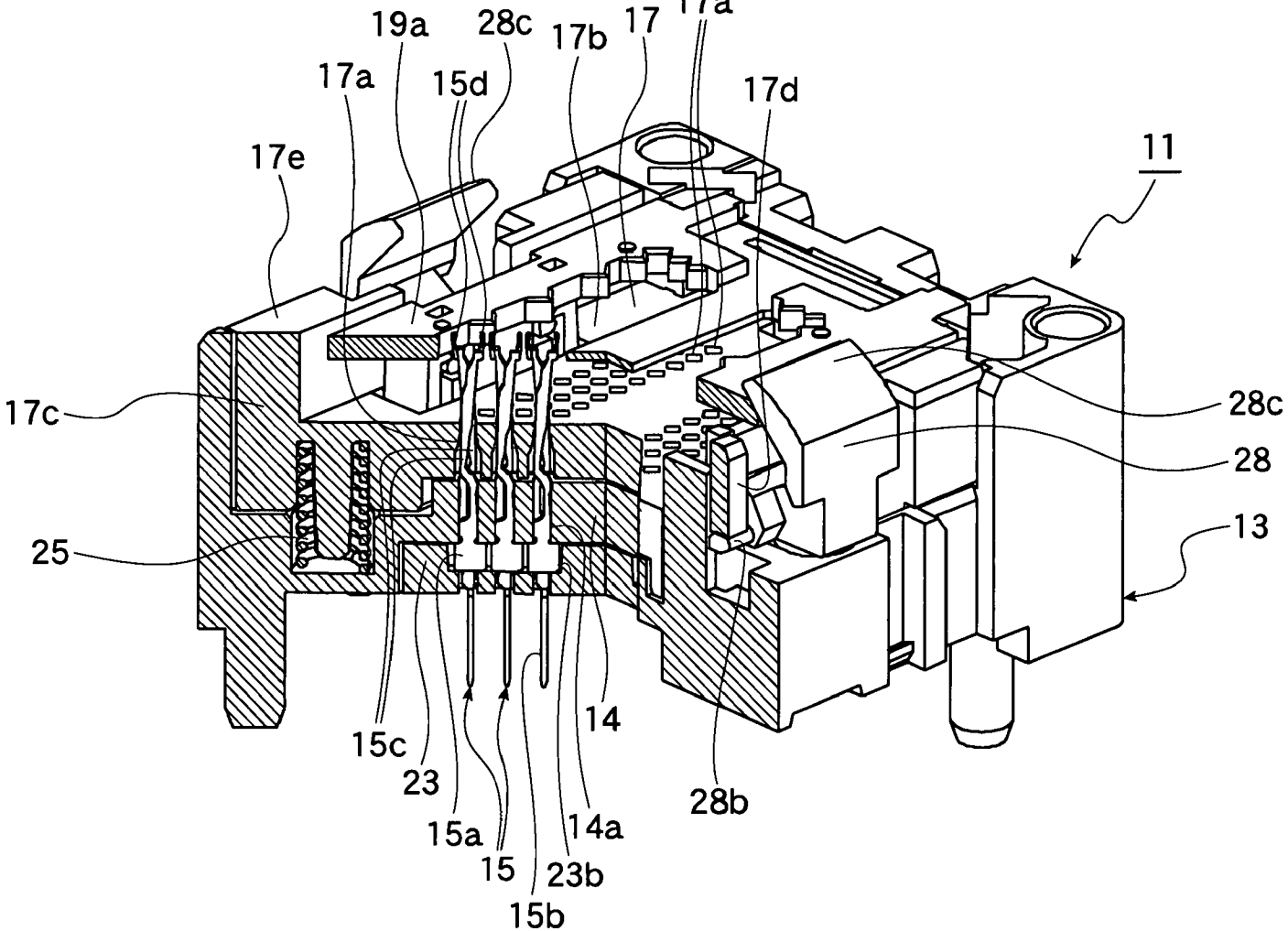
FIG. 19 is a perspective view, partially in section, of the IC socket of the second embodiment, in which a movable member takes a lowermost position thereof.

The latch member 28 includes, as shown in FIGS. 12 to 14, a rotation shaft (pivot) 28*a*, to which the socket body 13 is provided to be rotatable (pivotal). As also shown in FIG. 5, the latch member 28 is formed, at side portions thereof, with a pair of portions 28*b* to be pressed (pressed portions 28*b*) by a pressing portion 17*d* of the movable member 17. Furthermore, the latch member 28 is, as shown in FIG. 3, urged by a spring 29 in a direction to be closed, and a pressing portion 28*c* formed to the front end portion of the latch member 28 abuts against the upper surface of the peripheral edge portion of the IC package 12 to press down the IC package 12.

When the movable member 17 is moved downward, the pressing portion 17*d* of the movable member 17 presses the pressed portion 28*b* of the latch member 28, and then, the latch member 28 is rotated to be opened from a position shown with solid line in FIG. 3 to a position shown with a two-dot chain line in FIG. 3. Then, the pressing portion 28*c* of the latch member 28 is retired from the accommodation/take-out line of the IC package 12.

The operation member 21 has a square frame shape, which is arranged on the periphery of the guide member 19 and the socket body 13 to be movable in the vertical direction. The operation member 21 has a pressing surface 21*a* pressing a surface 17*e* to be pressed (pressed surface 17*e*) formed on the upper surface of the projection piece 17*c* of the movable member 17, and when pressed, the movable member 17 is moved downward against the urging force of the coil spring 25.

The IC socket 11 having the structure mentioned above will be usable in a manner described hereunder.

A printed circuit board on which a number of IC sockets 11 are arranged is preliminarily prepared, and then, in order to set the IC packages 12 respectively to the IC sockets 11 by using an automatic machine, the operation member 21 is first pressed downward.

According to this lowering motion of the operation member 21, the movable member 17 is pressed downward and then lowered against the urging force of the coil spring 25.

The lowering motion of the movable member 17 opens both paired contact portions 15*d* of each of the contact pins 15 and, hence, opens the latch member 28.

That is, when the movable member 17 is lowered, the portion 28*b* to be pressed of the latch member 28 is pressed by the pressing portion 17*d*, and against the urging force of the spring 29, the latch member 28 is rotated to the position shown with the two-dots-chain line in FIG. 3, and accordingly, the pressing portion 28*c* of the latch member 28 is retired from the accommodation/take-out line of the IC package 12.

Further, when the movable member 17 is lowered from the position shown in FIG. 6 to the position shown in FIG. 7, the bulged portions 15*h* of the elastic pieces 15*c* of each contact pin 15 are pressed against the peripheral wall portions of the insertion hole 17*a* of the movable member 17, and hence, the contact portions 15*d* of each contact pin 15 are opened, i.e., separated from each other.

In the state mentioned above, the IC package 12 is guided by the guides 19*b* and accommodated on the predetermined portion on the support pieces 19*a*, and the solder balls 12*b* of the IC package 12 are inserted, in non-contact state, between the opened pair of contact portions 15*d* of the contact pins 15, respectively, as shown in FIG. 7.

Thereafter, when the downward pressing force of the operation member 21 is released, the movable member 17 moves upward by the urging force of the coil spring 25, and then, the latch member 28 is rotated to the position in the closing direction by the urging force of the spring 29. Thus, the floating of the IC package 12 can be prevented by the pressing of the latch member 28.

Moreover, when the movable member 17 is moved upward, the pressing force to the slidable portions 15*g* of the contact pin 15 is released, and is then moved in the direction along which the paired contact portions 15*d* are closed (that is, the distance therebetween is narrowed) from the state shown in FIG. 7, thereby holding the solder ball 12*b* between both the contact portions 15*d*.

Therefore, the respective solder balls 12*b* of the IC package 12 and the printed circuit board are electrically connected through the contact pins 15, i.e., through the deformation of the contact pieces of the contact pins.

On the other hand, when it is required to dismount the IC package 12 from the state mounted to the socket, the movable member 17 is first lowered by the operation of the operation member 21 to thereby rotate so as to retire the latch member 28 from the accommodation/take-out range, and then, the paired contact portions 15*d* of the contact pin 15 are separated from the solder ball 12*b*, so that when the solder ball 12*b* is pulled out of the clamped state between the paired contact portions 15*d*, the solder ball 12*b* can be easily pulled out with weak force, thus easily removing the IC package 12.

According to the invention of the structure mentioned above, the preloading projection 15*f* of the contact pin 15 abuts against the inner wall of the insertion hole 14*a* of the base member 14, the elastic pieces 15*c* of the contact pin 15 are elastically deformed in the direction of closing a pair of contact portions 15*d* of the contact pin 15, thus applying preload.

In thus manner, even in the case of weak elastic force of the elastic pieces 15*c*, the contacting pressure of the contact portions 15*d* to the solder ball 12*b* can be ensured.

Accordingly, when both contact portions 15*d* are opened, they can be easily opened with a weak force and the sufficient opened amount, i.e., distance, can be ensured.

Therefore, even if a large number of contact pins 15 are arranged, both contact portions 15*d* of the respective contact pins 15 can be easily opened, and the contacting pressure thereof to the solder balls 12*b* can be also ensured.

In addition, since the preload is uniformly given to the paired elastic pieces 15*c*, and since the contact portions 15*d* can be opened or closed by the movable member, which is then moved vertically to open or close the contact portions 15*d*, the opposing uniform forces are applied to the insertion holes 17*a* of the movable member 17, so that no unidirectional force as a whole is applied to the movable member 17, thus effectively suppressing the deformation of the movable member 17, and accordingly, in this view point, an increased number of contact pins 15 can be arranged.

In the meantime, in a structure in which a preload is applied only to one of the elastic pieces 15*c* to thereby move the movable member 17 in the horizontal direction, a large force is applied only in one direction, i.e., to the entire structure of the movable member 17, so that there is a fear of the movable member 17 being deformed, which may constitute an obstacle for arrangement of a large number of contact pins 15.

Furthermore, according to the present invention, since the contact pin 15 is inserted into the insertion hole 14*a* of the base member 14 of the socket body 13 from the lower side toward the upper side, the base portion 15*a* of the contact pin 15 abuts against the lower surface of the base member 14 to thereby restrict the upper limit of the position of the contact portions 15*d* of the contact pin 15. Accordingly, the contact portion 15*d* do not project upward over the predetermined position, so that the solder ball 12*b* is less damaged.

Moreover, since the contact pins 15 are inserted at once into the insertion holes 14*a* and 17*a* from the lower side thereof in a state of the movable member 17 being arranged on the base member 14, the contact pins 15 and associated members or parts can be easily assembled.

Still furthermore, according to the described embodiment, the bottom plate 23 is disposed on the lower side of the base portions 15*a* of the contact pins 15 so as to prevent the base portions 15*a* from moving downward, so that the contact pins 15 can be maintained in their predetermined height level.

[Second Embodiment]

FIGS. 15 to 19 represent the second embodiment of the present invention.

The second embodiment differs from the first embodiment in that an operation member 21 in the first embodiment is not located, and the guide member only includes the support piece 19*a* and does not include the guide 19*b*.

In such structure of the second embodiment, the pressed surface 17*e* (horizontal surface) formed on the upper surface of the projection piece 17*c* of the movable member 17 is directly pressed by a head disposed on the package insertion/take-out device side, not shown.

Accordingly, with no use of the operation member 21, the number of constitutional members or parts can be reduced, and in addition, the surface 17*e* to be pressed has a horizontal surface perpendicular to the moving direction (vertical direction), so that the head side can be simply constructed, thus improving the strength thereof, and furthermore, there is not adopted a sliding structure, any wearing can be positively prevented, thereby improving the durability of the IC socket as well as such head, thus being effective.

The structures of the second embodiment other than the above different structure are substantially the same as those of the first embodiment, so that the details thereof are omitted herein.

Further, it is to be noted that the present invention is not limited to the described embodiments and many other changes and modifications may be made without departing from the scopes of the appended claims.

For example, in the described embodiments, although the present invention is utilized as the IC socket 11 for as a socket for electrical parts, the present invention is not limited thereto and may be applied to another device. Moreover, although the present invention is applied to the IC socket 11 for the BGA type IC package 12, it may be applied to an IC socket for a PGA (Pin Grid Array) type IC package. Furthermore, in the described embodiments, although the preloading projections 15*f* are formed, as preloading means, to the elastic pieces 15*c* of the contact pin 15, the preloading means may take various shapes, and may be arranged on the base member (14) side as projections.

What is claimed is:

1. A socket for an electrical part comprising:

a socket body to which an electrical part is accommodated, the socket body having a base portion to which a plurality of contact pins, having elastic pieces, which are contacted to or separated from terminals of the electrical part, are arranged;

a movable member disposed to the socket body above the base portion thereof to be vertically movable, deformation of the elastic pieces of the contact pins inserted into an insertion hole formed to the movable member being performed in accordance with the vertical movement of the movable member, according to the deformation thereof, contact portions formed to the contact pins being opened or closed; and a preloading member adapted to elastically deform the elastic pieces in a direction of closing the contact portions of the contact pins by exerting a force to push the contact pins at respective elastic pieces thereof, when the respective elastic pieces are inserted into insertion holes of the base portion of the socket body.

2. The socket for an electrical part according to claim 1, wherein said preloading member comprises preloading projections formed to a pair of elastic pieces of the respective contact pins, the paired elastic pieces are elastically deformed in the direction closing both the contact portions of the contact pins through abutment of the preloading projections against the inner wall of the insertion hole of the base portion.

3. The socket for an electrical part according to claim 1, wherein said contact pins are inserted upward from a lower side of the insertion hole of the base portion of the socket body.

4. The socket for an electrical part according to claim 3, wherein the contact pins are provided with stopper pieces, respectively, abutting against a lower surface of the base portion, and a support member is further disposed below the base portion adapted to block downward movement of the stopper member.

5. The socket for an electrical part according to claim 1, wherein said preloading member comprises preloading projections formed to a pair of elastic pieces of the respective contact pins, the paired elastic pieces having lower portions which are inserted into the insertion hole of the base portion, and the preloading projections formed to the lower portions of the elastic pieces so as to project sideways.

6. The socket for an electrical part according to claim 5, wherein the preloading projections abuts against an inner wall of the insertion hole of the base portion, when the lower portion of the contact pin is inserted into the insertion hole of the base portion.

7. A socket comprising:

a socket body to accommodate an electrical part therein, and comprising a base portion to which contact pins are arranged, the contact pins comprising elastic pieces and contact portions, and contacting and separating from terminals of the electrical part;

a movable member disposed on the socket body above the base portion and comprising an insertion hole to receive the elastic pieces of the contact pins and to be vertically movable, wherein deformation of the elastic pieces of the contact pins inserted into the insertion hole of the movable member is performed in accordance with a vertical movement of the movable member;

means for elastically deforming the elastic pieces in a direction of closing the contact portions of the contact pins by exerting a force to push the contact pins at respective elastic pieces thereof, when the respective elastic pieces are inserted into insertion holes of the base portion of the socket body.

8. The socket of claim 7, wherein the elastic pieces comprise preloading projections, wherein the preloading projections abut against an inner wall of a respective insertion hole of the insertion holes of the base portion.

9. The socket of claim 7, wherein the contact pins are inserted into the insertion holes of the base portion of the socket body from a lower side thereof, toward an upper side thereof, and a base portion of the contact pins abuts against a lower surface of the base portion of the socket body, to thereby restrict an upper limit of the contact portions of the contact pins.

10. The socket of claim 7, wherein the elastic pieces further comprise slidable portions formed at upper sides of a lower portion of the elastic pieces, the slidable portions projecting over the base portion of the socket body and being inserted into the insertion hole of the movable member, such that when the movable member moves vertically, inner wall portions of the insertion hole of the movable member slide along the slidable portions, and the elastic pieces are elastically deformed to thereby open and close the contact portions.

* * * * *